United States Patent [19]

Casey

[11] 4,335,497

[45] Jun. 22, 1982

[54] TERMINATING APPARATUS

[75] Inventor: Daniel T. Casey, Harrisburg, Pa.

[73] Assignee: AMP Incorporated, Harrisburg, Pa.

[21] Appl. No.: 122,539

[22] Filed: Feb. 19, 1980

[51] Int. Cl.[3] ..... H01R 43/04

[52] U.S. Cl. ..... 29/566.2; 29/566.3; 29/748; 29/753

[58] Field of Search ..... 29/566.2, 566.3, 33 M, 29/564.1, 748, 753, 749

[56] References Cited

U.S. PATENT DOCUMENTS

| | | | |
|---|---|---|---|
| Re. 26,646 | 8/1969 | Evans | 428/571 X |
| Re. 26,837 | 3/1970 | Evans | 339/17 LM X |
| 1,743,364 | 1/1930 | Liss | 29/566.3 X |
| 3,329,002 | 7/1967 | Schwalm | 29/753 X |
| 3,341,926 | 9/1967 | Ourr et al. | 29/564.1 X |
| 3,363,224 | 8/1968 | Evans | 339/258 R |
| 3,484,922 | 12/1969 | Fritz et al. | 29/753 |
| 3,628,202 | 12/1971 | Brown et al. | 29/748 |
| 3,628,228 | 12/1971 | Kerkhof | 29/753 X |
| 3,867,754 | 2/1975 | Koch et al. | 29/566.2 X |
| 4,034,449 | 7/1977 | Resch | 29/566.2 X |
| 4,082,402 | 4/1978 | Kinkaid et al. | 339/97 C |
| 4,139,937 | 2/1979 | L'Homme | 29/748 X |
| 4,164,065 | 8/1979 | Funcik et al. | 29/753 X |
| 4,214,361 | 7/1980 | Coldren et al. | 29/753 X |

*Primary Examiner*—William R. Briggs

[57] ABSTRACT

An apparatus is disclosed for terminating multi-conductor cable. A plurality of terminals are preloaded partially into a housing leaving their crimped terminating portions extending therefrom in such a position as they can be readily crimped connected to a cable. This allows for the terminals to be gang handled during the loading of the housing and yet be separated for individual termination on the cable. The cable can be crimped simultaneously to all of the terminals and the terminals fully inserted into the housing in subsequent operations. The terminal used with the subject apparatus includes an extra tine which serves alignment, stabilization, and cable positioning functions.

4 Claims, 9 Drawing Figures

TERMINATING APPARATUS

BACKGROUND OF THE INVENTION

1. The Field Of The Invention

The present invention relates to an apparatus for terminating multi-conductor flat flexible cable.

2. The Prior Art

It is heretofore been the practice to terminate multi-conductor flat flexible cable by sequentially applying terminals to the conductors of the cable. The thus terminated cable is then applied to the connector housing requiring that each terminal be individually applied to the appropriate terminal passage in the housing. While this is very convenient for the sequential application of the terminals to the cable, it is almost necessary to have a hand loading operation to assure that the free floating terminals are applied to their correct passages. The present invention overcomes the difficulties of this known system by partially preloading the terminals into the passages to a position where their crimp portions extend from the housing where they can be subsequently crimp terminated to a multiconductor flat flexible cable and then fully inserted into the housing.

SUMMARY OF THE INVENTION

The present invention concerns an, apparatus for terminating multi-conductor flat flexible cable and includes the steps of preloading a plurality of terminals into appropriate terminal passages in a housing only sufficiently far to insure their correct positioning therein while leaving their crimp terminating portions exposed. The cable to be terminated is applied to the exposed crimp terminating portions which are then crimp connected to the respective conductors of the cable. The thus terminated cable is then fully applied to the connector by driving all of the terminals completely into the housing. This can be readily accomplished since the terminals are all secured to the cable and are aligned in their respective passages in the housing.

The apparatus for accomplishing the above termination method includes a terminal having a known mating portion and a known crimping portion with an intermediate portion including a tine initially extending at right angles to the longitudinal axis of the terminal. This tine serves as for stabilization of the terminal within the housing as well as cable and terminal alignment means. The tine is subsequently curled down during the crimping step to enable passage of the crimped terminal into its appropriate passageway in the housing.

The apparatus for effecting the above termination method includes an applicator which simultaneously severs a carrier strip from a plurality of terminals which have been partially preloaded into a housing and crimp terminates the conductors of a flat flexible cable to the respective terminals extending from the housing.

It is therefore an object of the present invention to produce an improved apparatus for terminating the conductors of a multi-conductor flat flexible cable onto a plurality of terminals which have been partially preloaded into a housing.

It is another object of the present invention to teach a method of terminating multi-conductor flat flexible cable by partially loading a plurality of terminals into a connector housing, then gang crimping the terminals to the respective conductors of a multi-conductor flat flexible cable and subsequently fully inserting the crimped terminals into the housing.

It is another object of the present invention to produce an improved terminal having, in addition to a crimp portion and a mating portion, an intermediate tine which serves to align the terminal with respect to the housing, to stabilize the terminal in the housing and to position the cable with respect to the terminal prior to being crimped so as to be receivable within the housing.

It is a further object of the present invention to produce a terminal and apparatus which can be readily and economically manufactured.

The means for accomplishing the foregoing objects and other advantages of the present invention will be apparent to those skilled in the art from the following detailed description taken with reference to the accompanying drawings.

DETAILED DESCRIPTION OF THE PREFERRED EMBODIMENT

Figure 1:
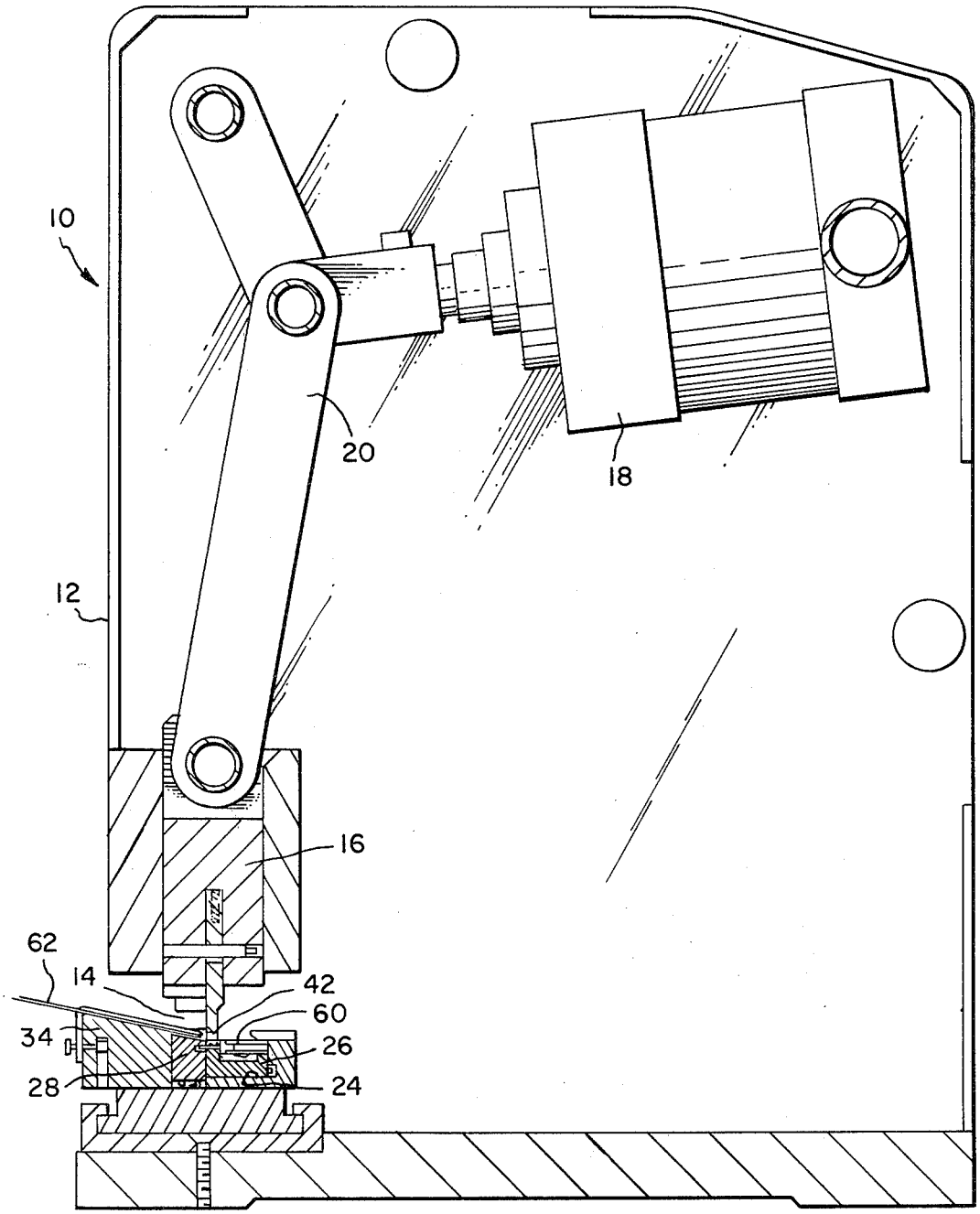
FIG. 1 is a vertical transverse section through a crimp apparatus according to the present invention.
Figure 2:
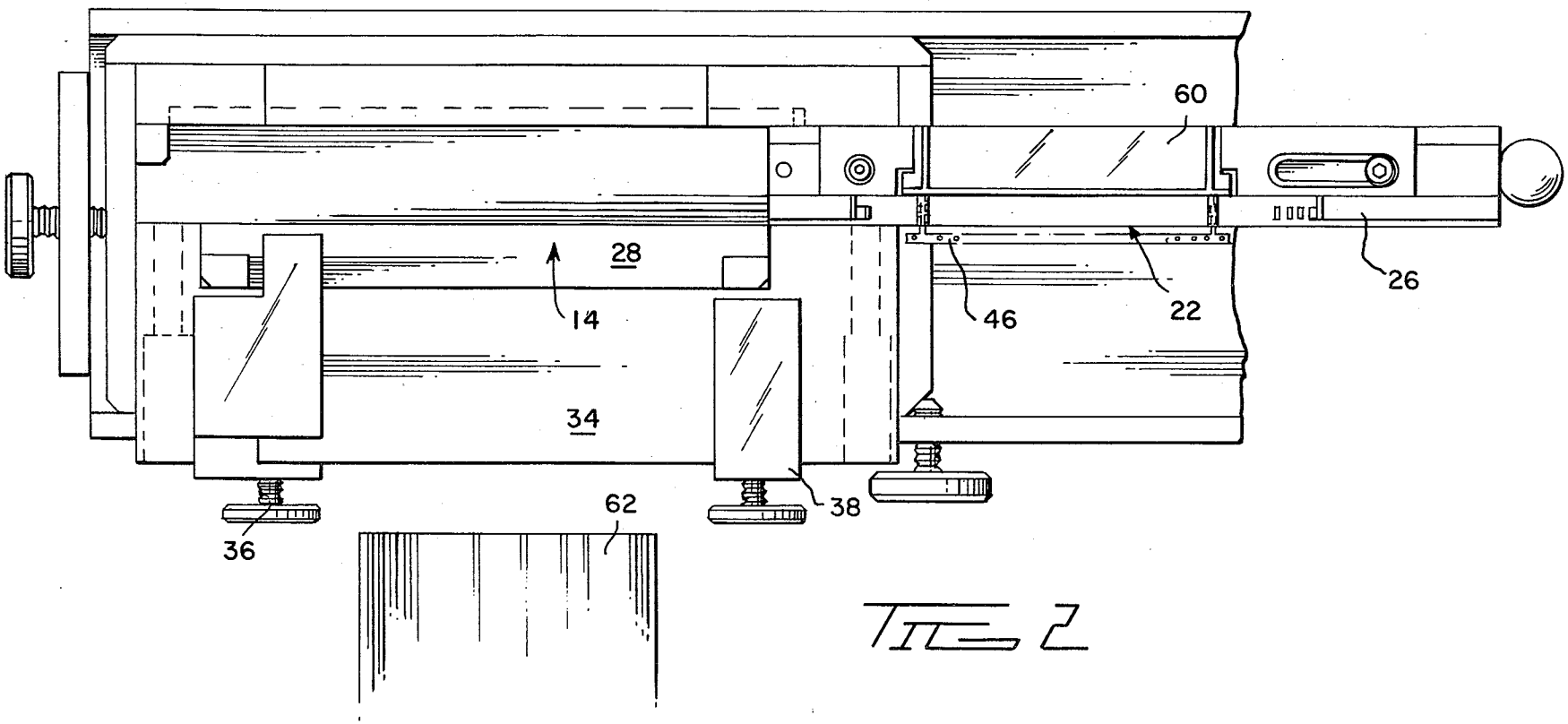
FIG. 2 is a top plan view through the apparatus of FIG. 1.
Figure 3:
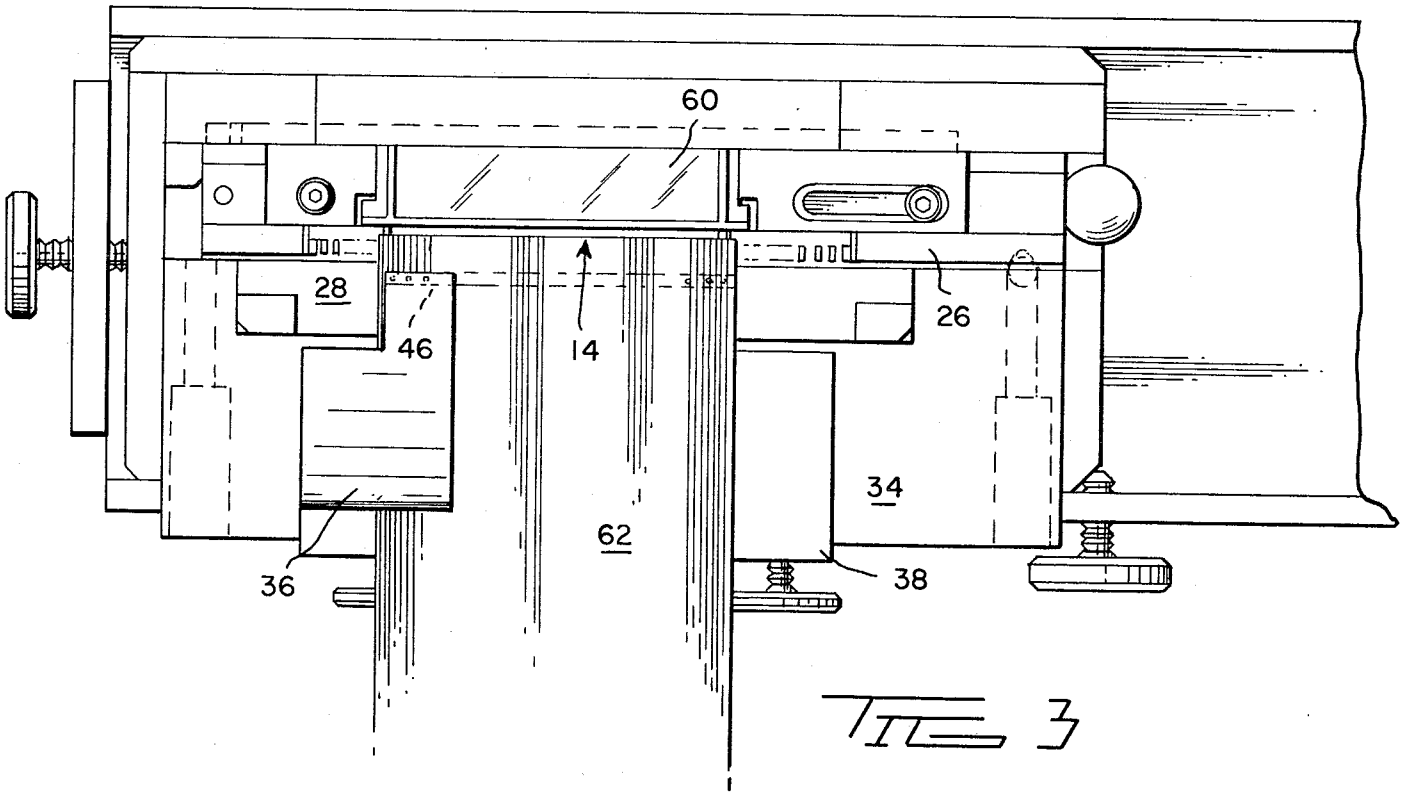
FIG. 3 is a view similar to FIG. 2 showing the subject apparatus during crimping of a cable.

The applicator is shown in FIGS. 1 to 3 and includes a housing 12 having a work station 14 positioned beneath a ram 16 which is vertically driven by a pneumatic cylinder 18 through linkages 20. A feed path leads from a loading station 22 into the work station 14 and includes a trough 24 in which a connector housing holding jig 26 slides. The holding jig 26 has a connector housing supporting portion 25 and an adjacent crimp anvil 27. A carrier strip shear bar 28 forms the front wall of the trough 24 in the work station. The shear bar 28 is biased upwardly by springs 30 so that its upper surface 32 normally forms a continuation of the fixed inclined cable receiving member 34. Adjustable cable alignment members 36, 38 are positioned toward opposite ends of the member 34 which can have a fluted surface for alignment of the cable. A horizontal channel 40 is formed in the shear bar directed towards the trough 24. The ram 16 carries a crimp tool 42 and shear bar actuation extension 44.

Figure 4:
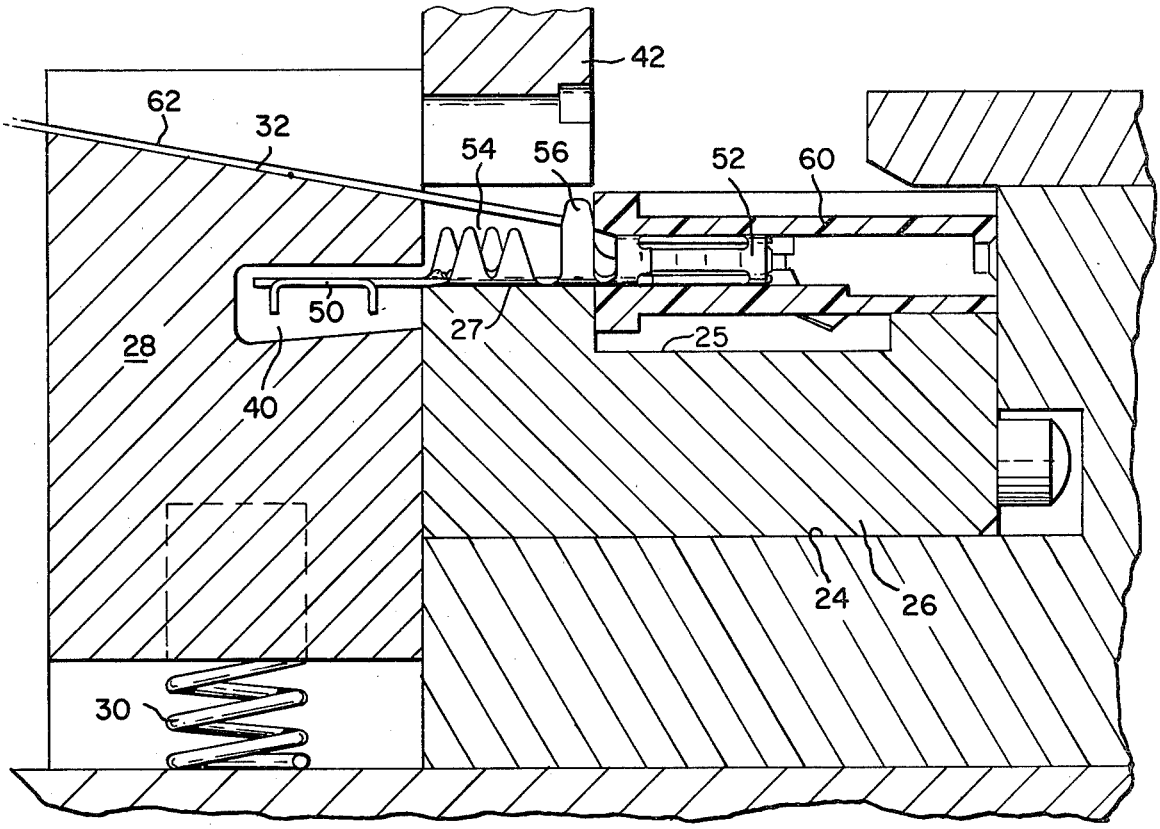
FIG. 4 is a detailed section through the crimp portion of the subject apparatus immediately prior to effecting a crimp.
Figure 6:
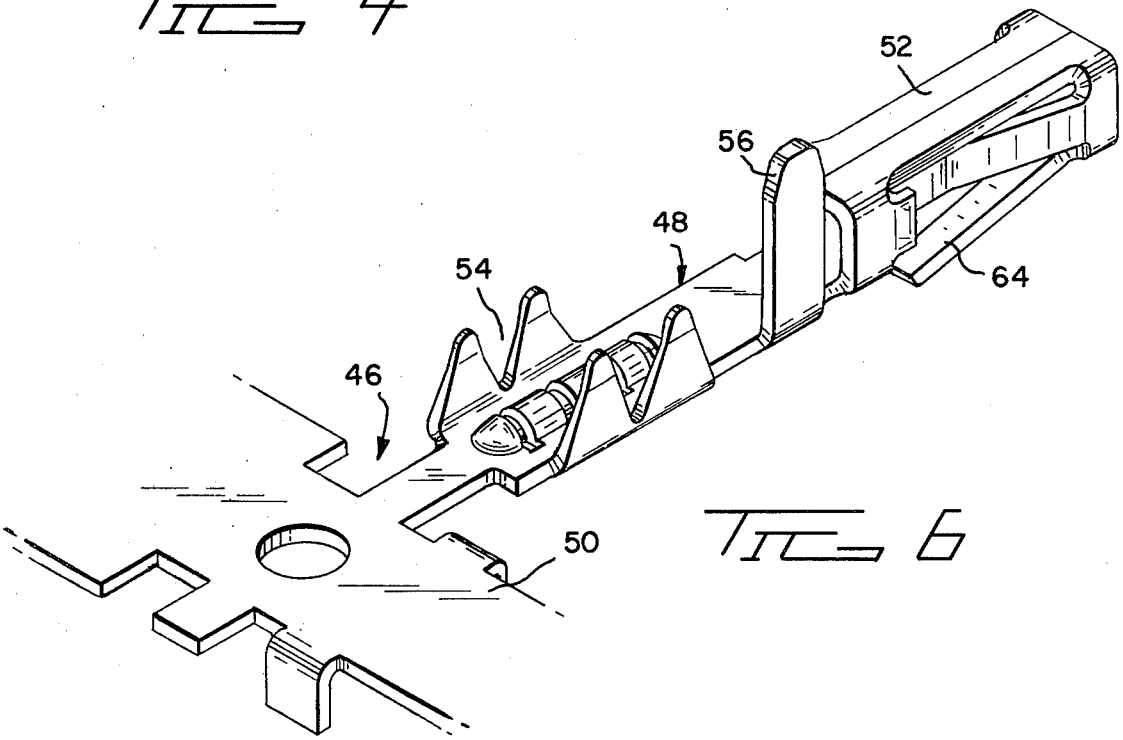
FIG. 6 is a perspective of a terminal according to the present invention while still attached to a carrier strip.
Figure 7:
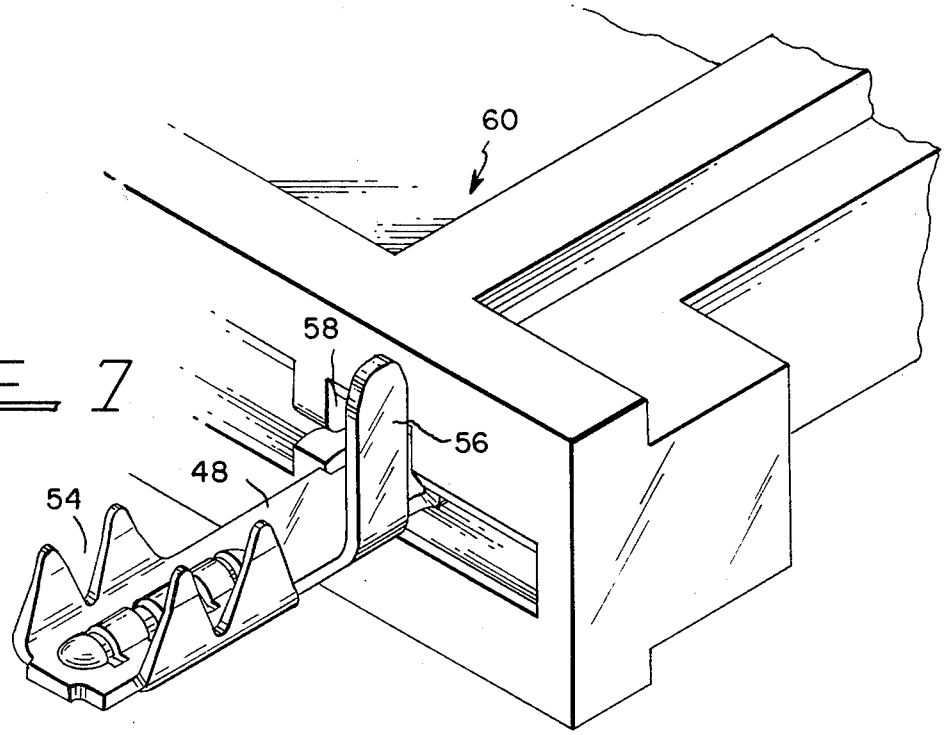
FIG. 7 is a perspective view of the subject terminal in its initial condition partially inserted into a housing and prior to crimping.

The subject terminal strip 46 can most clearly be seen in FIG. 6 including a plurality of terminals 48 extending from a carrier strip 50. It should be here noted that strips of the subject terminals can be stacked double, in the manner shown in U.S. Pat. No. 4,021,095, so that the terminals will be on a closer center line spacing than would be possible to stamp them out from conventional stock. Each terminal has a mating portion 52 which is here shown as a receptacle of the type shown in U.S. Pat. Nos. Re 26,646, Re 26,837, and 3,363,224 and a crimp portion 54 which is of the type described in U.S. Pat. No. 4,082,402. Intermediate these two portions is a tine 56 which extends normal to the axis of the terminal and to one side of the body thereof. The function of this tine can best be seen from FIGS. 4 and 7 in which it will be noted that the tine 56 serves to align the terminal 48 with respect to the terminal passage 58 in housing 60 and prevent the initial full insertion of the terminal into the passage. It will also be noted from FIG. 4 that the tine 56 also serves as an abutment against which the cable 62 is placed prior to termination and thus assures the proper alignment of the cable with respect to the crimp portion 54 of the terminal.

Figure 5:
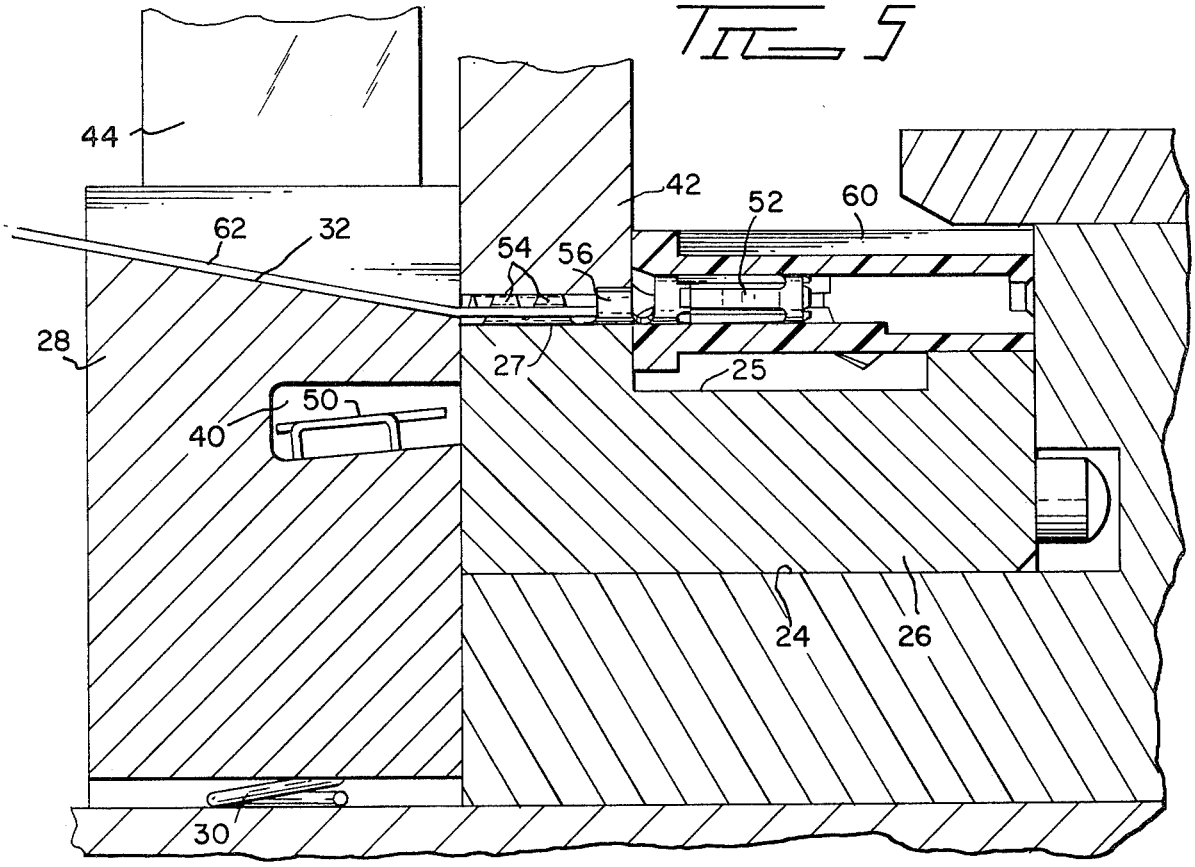
FIG. 5 is a view similar to FIG. 4 showing the apparatus during crimping.
Figure 8:
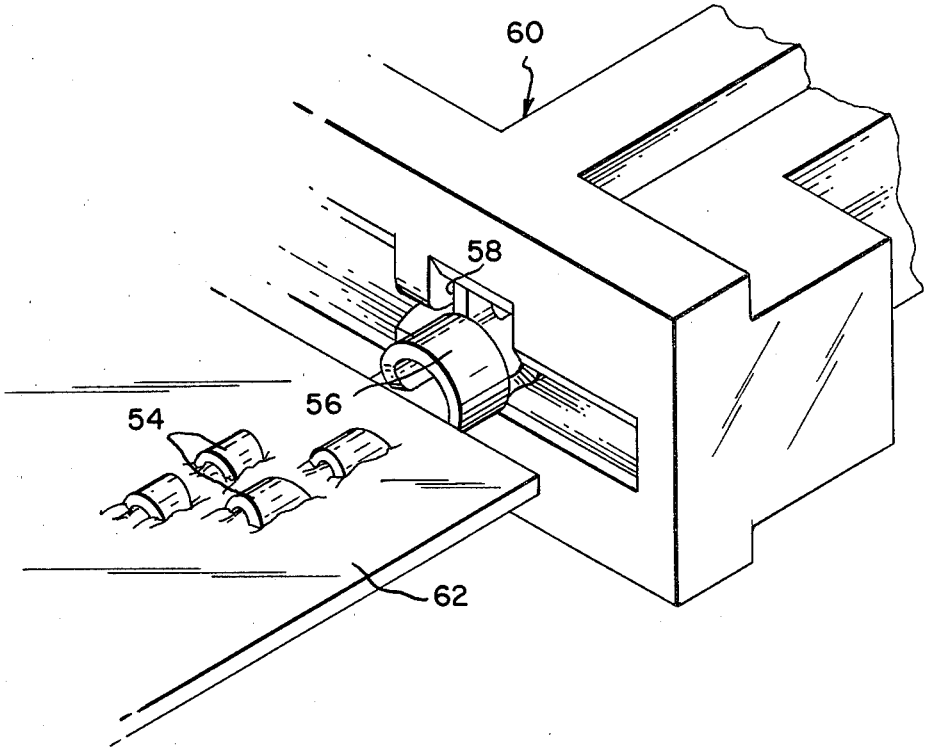
FIG. 8 is a view similar to FIG. 7 showing the subject terminal immediately after crimping and prior to full insertion into the housing.

The crimping of the terminal on the cable can be seen from FIGS. 5 and 8 with the crimp tool 42 effecting both a crimp of the crimp portion 54 against crimp anvil 27 and a curling down of the tine 56 so that it will be free of the housing and allow full insertion of the terminal into the passage 58. Simultaneously with the crimping, the carrier strip 50 is sheared from the terminals 48 by the shear bar 26 being driven downward against springs 30 by actuation member 44.

Figure 9:
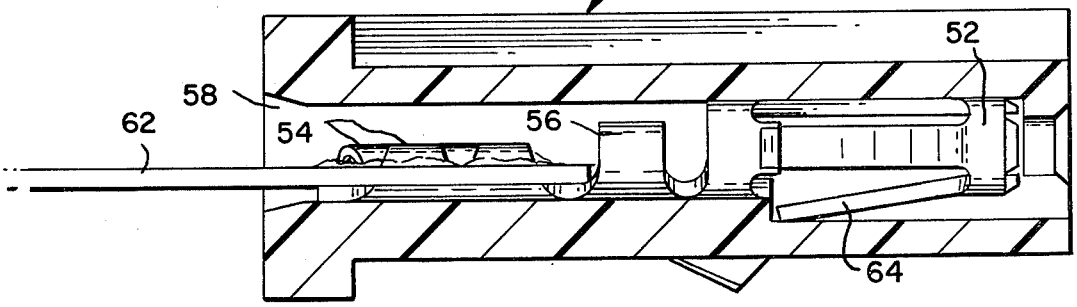
FIG. 9 is a vertical transverse section through the housing showing the crimped terminal in a fully inserted condition.

After the terminals have been crimped to the respective conductors of the cable, the cable is pushed forwardly to fully insert the terminals into the housing where lances 64 (see FIG. 9) engage to hold the terminals and cable in place.

The present invention may be subject to many modifications and changes without departing from the spirit or essential characteristics thereof. The present embodiment is therefore to be considered in all respects as illustrative and not restrictive as to the scope of the invention.

What is claimed is:

1. An apparatus for terminating multiconductor flat cable with a connector having a housing preloaded with a plurality of terminals connected to a carrier strip, each terminal having a crimp portion exposed from said connector housing, a tine extending from an intermediate portion serving to initially stabilize said terminal, prevent its full insertion into said housing and align said cable with respect to said crimp portion, and a mating portion lying within said housing, said apparatus comprising:

a press having a vertically actuatable ram carrying crimp tooling on the lower end thereof, said crimp tooling having an elongated profile for simultaneously crimping both said crimp portion and said tine of each terminal of said plurality of terminals;

trough means defining a feed path extending transversely from a remote loading station to a work station beneath said ram;

at least one connector carrying jig slidably mounted in said trough;

a cable support aligned with said ram and extending normally to one side of said trough; and a shear bar intermediate said cable support and said trough forming one wall of the latter, said crimp tooling driving said shear bar with respect to said jig to effect shearing of said carrier strip from said terminals;

whereby said carrier strip is sheared from the plurality of terminals and each terminal crimped to a respective conductor of a cable and said tines curled downwardly against said cable by actuation of said crimp tooling carried by said ram to both terminate said cable and allow full insertion of said terminals into said housing.

2. An apparatus according to claim 1 further comprising: adjustable cable guide means on said cable support.

3. An apparatus according to claim 1 wherein each said at least one jig has a connector housing supporting portion and adjacent crimp anvil supporting said crimp portion of said terminals, said crimp anvil cooperating with said crimp tooling to effect crimping of said terminals.

4. An apparatus according to claim 1 wherein said shear bar is an elongated member having a groove extending the length thereof and directed towards said trough means, means biasing said shear bar to a first position in which said carrier strip is received in said groove, said crimp tooling driving said shear bar to a second position to effect said shearing of said carrier strip.

* * * * *